US009976328B2

(12) United States Patent
Kim et al.

(10) Patent No.: US 9,976,328 B2
(45) Date of Patent: May 22, 2018

(54) REFRIGERATOR HINGE AND MANUFACTURING METHOD THEREOF

(71) Applicant: LG ELECTRONICS INC., Seoul (KR)

(72) Inventors: Pansoo Kim, Seoul (KR); Raeyoung Park, Seoul (KR)

(73) Assignee: LG Electronics Inc., Seoul (KR)

( * ) Notice: Subject to any disclaimer, the term of this patent is extended or adjusted under 35 U.S.C. 154(b) by 89 days.

(21) Appl. No.: 15/171,208

(22) Filed: Jun. 2, 2016

(65) Prior Publication Data

US 2016/0356542 A1 Dec. 8, 2016

(30) Foreign Application Priority Data

Jun. 5, 2015 (KR) ..... 10-2015-0079617

(51) Int. Cl.
*E05D 7/08* (2006.01)
*E05D 7/081* (2006.01)
(Continued)

(52) U.S. Cl.
CPC ..... *E05D 7/081* (2013.01); *E05D 5/0276* (2013.01); *E05D 7/1044* (2013.01);
(Continued)

(58) Field of Classification Search
CPC .. E05D 7/00; E05D 7/08; E05D 7/081; E05D 7/10; E05D 7/1005; E05D 7/1044;
(Continued)

(56) References Cited

U.S. PATENT DOCUMENTS 1,681,032 A * 8/1928 Fuller ..... E05D 5/04 16/270
1,740,866 A * 12/1929 McBarron ..... E05D 11/10 16/293
(Continued)

FOREIGN PATENT DOCUMENTS

CN 102128536 7/2011
CN 103742014 4/2014
(Continued)

OTHER PUBLICATIONS

Chinese Office Action in Chinese Application No. 201610352821.0, dated Jul. 3, 2017, 19 pages. (with English translation).
(Continued)

*Primary Examiner* — Jeffrey O'Brien
(74) *Attorney, Agent, or Firm* — Fish & Richardson P.C.

(57) ABSTRACT

A refrigerator hinge includes a hinge supporter configured to be mounted on a front surface of a cabinet of a refrigerator, the hinge supporter defining a fitting hole and including a bracket support portion that at least partially surrounds an edge of the fitting hole and protrudes from a front surface of the hinge supporter, a hinge bracket configured to be perpendicularly coupled to the hinge supporter, the hinge bracket including an insertion portion that protrudes from a first end of the hinge bracket and is configured to be inserted into the fitting hole, and a hinge pin configured to be coupled to a second end of the hinge bracket opposite the first end. When the hinge bracket is coupled to the hinge supporter, an inner edge of the bracket support portion contacts an outer circumferential surface of the hinge bracket.

11 Claims, 15 Drawing Sheets

(51) Int. Cl.
*F25D 23/02* (2006.01)
*E05D 5/02* (2006.01)
*E05D 7/10* (2006.01)

(52) U.S. Cl.
CPC ..... *F25D 23/028* (2013.01); *E05Y 2900/31* (2013.01); *F25D 2323/024* (2013.01); *Y10T 16/535* (2015.01); *Y10T 16/5363* (2015.01)

(58) Field of Classification Search
CPC ..... E05D 7/12; E05D 7/123; E05D 2007/126; E05D 5/02; E05D 5/0223; E05D 5/023; E05D 5/0238; E05D 5/04; E05D 5/046; E05D 5/06; E05D 5/065; F25D 2323/024
USPC ..... 16/254, 270, 271, 272
See application file for complete search history.

(56) References Cited

U.S. PATENT DOCUMENTS 3,065,498 A * 11/1962 Johnson ..... E05D 1/04 16/359
3,290,109 A * 12/1966 Vanegas ..... E05D 7/04 312/326
5,156,096 A * 10/1992 Lamprey ..... A47B 96/027 108/108
5,871,229 A * 2/1999 Saito ..... B60R 21/2165 280/728.3
6,030,064 A * 2/2000 Kim ..... E05D 7/0423 16/271
8,011,064 B2 * 9/2011 Leimkuehler ..... E05D 11/0054 16/251
8,079,114 B2 * 12/2011 Fries ..... E05D 7/02 16/235
8,491,070 B2 * 7/2013 Davis ..... F25D 23/028 312/326
9,556,657 B2 * 1/2017 Yi ..... B21D 53/40
9,703,327 B2 * 7/2017 Sprenger ..... G06F 1/1681
2006/0017361 A1 * 1/2006 Rendel ..... E05D 11/0081 312/405
2010/0231110 A1 * 9/2010 Choi ..... E05D 5/02 312/405
2012/0080989 A1 * 4/2012 Davis ..... F25D 23/028 312/405
2013/0249371 A1 * 9/2013 Lively ..... F25D 23/028 312/404
2014/0333191 A1 * 11/2014 Sun ..... F25D 23/00 312/404
2015/0368944 A1 * 12/2015 Yi ..... B21D 53/40 312/405

FOREIGN PATENT DOCUMENTS

| | | |
|---|---|---|
| CN | 105318635 | 2/2016 |
| DE | 102010039743 | 3/2012 |
| JP | S63-233283 | 6/1988 |
| KR | 100631459 | 9/2006 |
| KR | 10-2007-0011755 | 1/2007 |
| WO | 2012/025402 | 3/2012 |

OTHER PUBLICATIONS

Extended European Search Report ssued in European Application No. 16172647.6 dated Nov. 3, 2016, 10 pages.

* cited by examiner

REFRIGERATOR HINGE AND MANUFACTURING METHOD THEREOF

CROSS-REFERENCE TO RELATED APPLICATION(S)

This application claims priority under 35 U.S.C. § 119 and 35 U.S.C. § 365 to Korean Patent Application No. 10-2015-0079617, filed in Korea on Jun. 5, 2015, whose disclosure is hereby incorporated by reference in its entirety.

FIELD

The present disclosure is related to a refrigerator hinge and a manufacturing method of making the same.

BACKGROUND

Generally, a refrigerator is a home appliance which enables food to be stored at a low temperature in an internal storage space covered by a door. The refrigerator may be configured so that an inside of the storage space is cooled using cooling air generated through heat exchange with a refrigerant circulated through a refrigeration cycle, and thus the stored food may be stored in an optimum state.

Many recent refrigerators have become bigger and have become multifunctional based on changes in consumers' dietary life and a trend toward high-quality product. Refrigerators having various structures and equipment for convenience in consideration of user convenience have been brought to the market.

Typically, refrigerator doors are opened and closed in a rotating manner. To this end, the door and a main body in which the storage space is formed may be rotatably coupled by a hinge. In some cases, a hinge may include a hinge plate fixed to a main body and a hinge pin connecting the hinge plate to a door to serve as a rotation shaft of the door. In some cases, a hinge may include a mounting plate on which a hinge pin is installed and a vertical flange to which the mounting plate is riveted.

SUMMARY

According to one aspect, a refrigerator hinge includes a hinge supporter configured to be mounted on a front surface of a cabinet of a refrigerator, the hinge supporter defining a fitting hole and including a bracket support portion that at least partially surrounds an edge of the filling hole and protrudes from a front surface of the hinge supporter, a hinge bracket configured to be perpendicularly coupled to the hinge supporter, the hinge bracket including an insertion portion that protrudes from a first end of the hinge bracket and is configured to be inserted into the fitting hole, and a hinge pin configured to be coupled to a second end of the hinge bracket opposite the first end. Based on the hinge bracket being coupled to the hinge supporter, an inner edge of the bracket support portion contacts an outer circumferential surface of the hinge bracket.

Implementations according to this aspect may include one or more of the following features. For example, the fitting hole may have a non-circular shape. In some cases, the fitting hole may have a quadrangular shape. The hinge supporter may include a rear surface configured to contact the front surface of the cabinet, and a front surface opposite the rear surface, wherein the bracket support portion protrudes from the front surface of the hinge supporter and is convexly rounded relative to the front surface. The hinge supporter may define a supporter recessed portion that is recessed into the rear surface of the hinge supporter, and the fitting hole may be defined within the supporter recessed portion. Additionally, a volume of the supporter recessed portion may correspond to a volume of the bracket support portion. A rear end of the fitting hole may include an expanding portion, and the insertion portion may be configured to deform to completely fill the fitting hole and the expanding portion. The insertion portion, prior to being deformed to completely fill the fitting hole and the expanding portion, may not protrude rearward past the rear surface of the hinge supporter. In some cases, the insertion portion may include an insertion part that is configured to be positioned within the fitting hole, and an expanding part that is configured to be positioned at the expanding portion, the expanding part extending from an end of the insertion part and configured to expand.

In some implementations, outer surfaces of the hinge supporter and the hinge bracket may include a surface treatment layer. The surface treatment layer may be plated or painted on the outer surfaces of the hinge supporter and the hinge bracket. In some cases, the insertion portion may include a first insertion portion which extends from a first location on the hinge bracket, and a second insertion portion which extends from a second location on the hinge bracket, the second insertion portion being laterally spaced apart from the first insertion portion. Here, the fitting hole may include a first fitting hole configured to receive the first insertion portion, and a second fitting hole configured to receive the second insertion portion. Sometimes, the first fitting hole and the second fitting hole may have the same shape. In some cases, the second insertion portion may include a pair of protruding portions that are located at left and right sides of the first insertion portion, respectively, and a width of the first insertion portion may be larger than a width of each of the pair of the protruding portions. The second fitting hole may be smaller than the first fitting hole.

According to another aspect, a method of manufacturing a refrigerator hinge includes preparing a hinge supporter that defines a fitting hole and an expanding portion that expands from a rear end of the fitting hole, wherein the hinge supporter includes a hinge bracket having a protruding insertion portion and is configured to be inserted into the fitting hole, and wherein a width of a left edge of the insertion portion and a width of right edge of the insertion portion are different from each other, inserting the insertion portion into the fitting hole so that the hinge bracket forms a right angle relative to the hinge supporter, and deforming, based on the insertion portion being inserted into the fitting hole, a shape of the insertion portion by pressing an end of the insertion portion using at least one of a press working, a riveting, or a spinning process.

Implementations according to this aspect may include one or more of the following features. For example, the insertion portion may include a first surface that defines either a left side or a right side of the insertion portion, a second surface opposite the first surface, and a third surface that connects an end of the first surface with an end of the second surface. Here, one of a thickness of the first surface or a thickness may correspond to a vertical width of the fitting hole, and the other may be smaller than the vertical width of the fitting hole. Also, the method may further include, based on the insertion portion being completely inserted into the fitting hole, machining the third surface by using at least one of the press working, the riveting, or the spinning process. In some cases, the method may further include deforming, by using at least one of the press working, the riveting, or the spinning process, the insertion portion to completely fill the fitting hole and the expanding portion.

BRIEF DESCRIPTION OF THE DRAWINGS

Implementations will be described in detail with reference to the following drawings in which like reference numerals refer to like elements, and wherein.

DETAILED DESCRIPTION

Hereinafter, exemplary implementations of the present disclosure will be described with reference to the accompanying drawings.

For convenience of understanding and explanation, an implementation of the present disclosure describes an example of a bottom freezer type refrigerator in which a freezer compartment is located under a refrigerator compartment, and one pair of refrigerator compartment doors are provided at left and right sides. However, the present disclosure is not limited thereto, and may be applied to all types of refrigerators in which the door is rotatably installed through a hinge.

Figure 1:
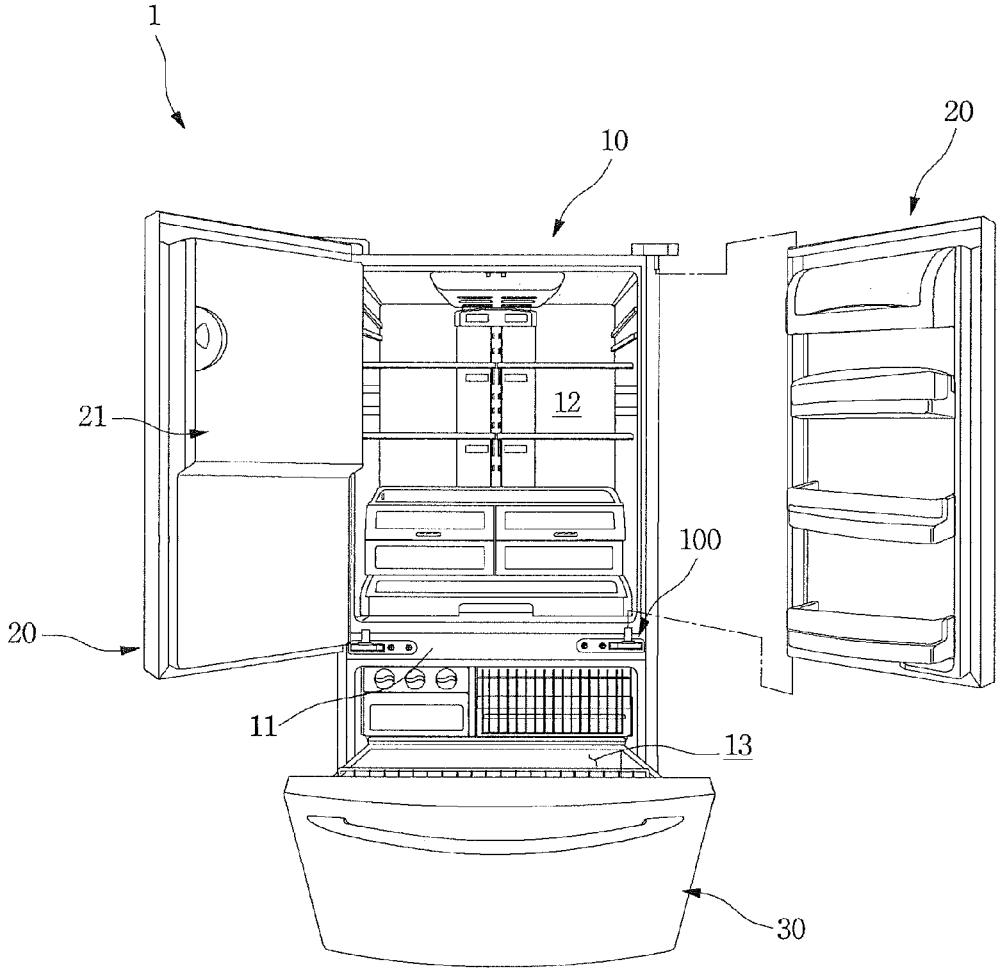
FIG. 1 is a perspective view showing an example refrigerator having an installation structure of an example hinge.
Figure 2:
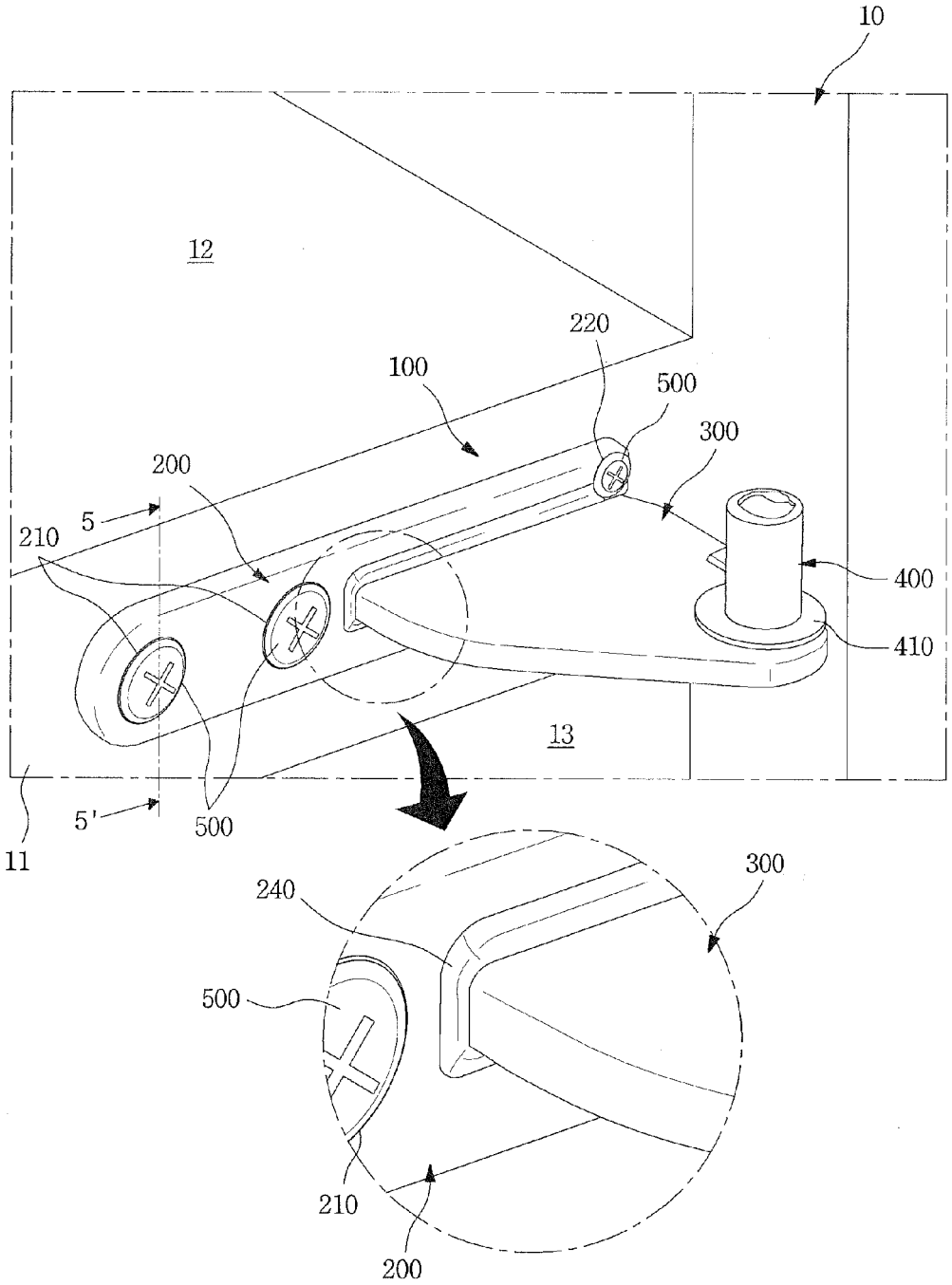
FIG. 2 is a perspective view showing an installed state of the hinge.
Figure 3:
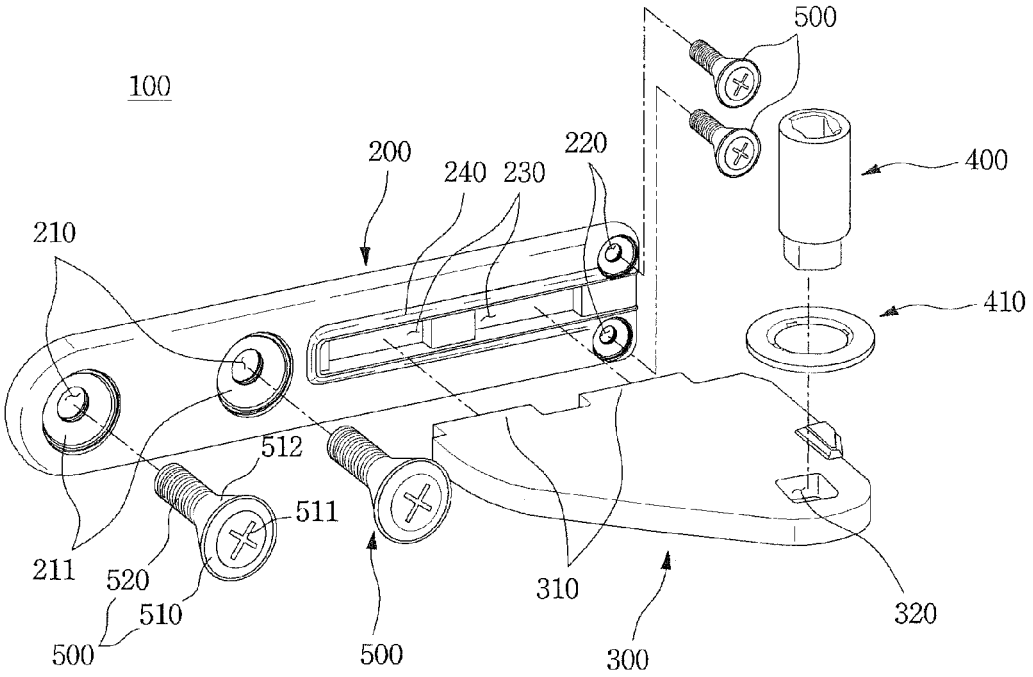
FIG. 3 is an exploded perspective view showing a front side of the hinge.

Referring to FIG. 1, a refrigerator 1 according to an implementation of the present disclosure may include a cabinet 10 which forms a storage space, and doors 20 and 30 which are provided at a front surface of the cabinet 10 to open and close the storage space.

The storage space inside the cabinet 10 may be vertically divided by a barrier 11, and a refrigerator compartment 12 may be formed at an upper side, and a freezer compartment 13 may be formed at a lower side. And a plurality of drawers, shelves, and baskets may be provided inside the refrigerator compartment 12 and the freezer compartment 13 so as to accommodate food.

The doors 20 and 30 may include a refrigerator compartment door 20 which opens and closes the refrigerator compartment 12, and a freezer compartment door 30 which opens and closes the freezer compartment 13. The freezer compartment door 30 is provided at a front surface of the freezer compartment 13, and an accommodation box provided at a rear surface of the freezer compartment door 30 may be provided in a drawer type. Therefore, the accommodation box may be inserted into an inside of the freezer compartment 13, and the freezer compartment door 30 opens and closes the freezer compartment 13. A pair of refrigerator compartment doors 20 may be provided at both of left and right sides of a front surface of the refrigerator compartment 12, and may be installed to be rotated independently and to open and close the refrigerator compartment 12.

An ice machine 21, a dispenser, and a plurality of baskets for accommodating the food may be provided at the refrigerator compartment door 20.

Upper and lower ends of the refrigerator compartment door 20 may be respectively coupled to the cabinet 10 through a hinge, and installed to be rotated using the hinge as a rotating shaft. The hinge may include an upper hinge that connects the upper end of the refrigerator compartment door 20 with an upper end of the cabinet 10, and a lower hinge 100 that connects the lower end of the refrigerator compartment door 20 with the front surface of the cabinet 10.

Hereinafter, the lower hinge 100 which supports the refrigerator compartment door 20 will be described in detail.

Referring to FIGS. 2 to 6, the hinge 100 according to one implementation of the present disclosure may include a hinge supporter 200 that is installed and fixed to the front surface of the cabinet 10, a hinge pin 400 that is inserted into a lower end of the door 20 and serves as a rotating shaft, and a hinge bracket 300 at which the hinge pin 400 is installed and which is coupled to the hinge supporter 200 and supports the door 20.

The hinge supporter 200 may be made of a metal plate having a predetermined thickness, and a thickness of the hinge supporter 200 may be changed according to a weight of the door 20. The hinge supporter 200 may be installed at the front surface of the cabinet 10 corresponding to the lower end of the door 20, and may be installed at a front surface of the barrier 11 in the implementation.

One end of the hinge supporter 200 may be formed to be rounded by a press working, for example, and the hinge supporter 200 may include a plurality of fastening holes 210 and 220 and a fitting hole 230.

Specifically, the fastening holes 210 and 220 may include a main fastening hole 210 which is disposed to be spaced apart in a lengthwise direction of the hinge supporter 200, and a sub-fastening hole 220 which is disposed in a width direction thereof.

The main fastening hole 210 may be provided at one side of the fitting hole 230, and a plurality of main fastening holes 210 may be disposed to be spaced apart from each other at a predetermined interval. An end of the hinge supporter 200 at which the main fastening hole 210 is formed may be formed to be rounded with a predetermined curvature.

A taper portion 211 which is inclined so that a width becomes narrower may be formed between an inlet port and an outlet port of the main fastening hole 210, and thus an inner diameter of the outlet port of the main fastening hole 210 may be smaller than that of the inlet port thereof. Here, the inlet port of the main fastening hole 210 may be defined as a portion in which a fastening member is inserted, and the outlet port may be defined as a portion which is opposite to the inlet port, i.e., through which the fastening member is withdrawn.

The taper portion 211 may be formed to have a predetermined gradient regardless of the thickness of the hinge supporter 200, and a head portion of a fastening member 500 fastened to the main fastening hole 210 may be in close contact with and fixed to an inside of the main fastening hole 210 regardless of the thickness of the hinge supporter 200.

The sub-fastening hole 220 may be disposed at the other side of the hinge supporter 200, at which the fitting hole 230 is located, in the width direction (or a vertical direction) of the hinge supporter 200, and disposed at an upper side and a lower side of the fitting hole 230. At this point, the sub-fastening hole 220 may be located at an upper edge and a lower edge of the hinge supporter 200, and may be formed to have a size which does not interfere with the fitting hole 230. Also, the sub-fastening hole 220 may be formed to have a diameter smaller than that of the main fastening hole 210, and a taper portion (which is the same as the taper portion 211) may be formed therein.

The fastening member 500 is inserted into the main fastening hole 210 and the sub-fastening hole 220, and thus the hinge supporter 200 may be installed and fixed to the front surface of the cabinet 10. The fastening member 500 may have a length that allows it to through the main fastening hole 210 and the sub-fastening hole 220 and is designed to be fastened to the cabinet 10.

In some cases, the fastening member 500 may include a head portion 510 which is seated on the fastening holes 210 and 220, and a fastening portion 520 which passes through the fastening holes 210 and 220 and inserted and fixed into the cabinet 10.

A tool groove 511 may be formed at a front surface of the head portion 510 which is exposed through the inlet port of each of the fastening holes 210 and 220, such that a fastening operation may be performed using a tool such as a screwdriver, and a seating surface 512 which is formed to be inclined may be formed at a circumference of the head portion 510.

The seating surface 512 may be formed to have a slope corresponding to that of the taper portion 211 formed at each of the fastening holes 210 and 220, and may be formed to have the same slope regardless of a size of the fastening member 500. In other words, a length of the fastening portion 520 of the fastening member 500 may be changed according to a type thereof, but a shape and a size of the head portion 510 may remain constant.

The fastening portion 520 may extend backward from a rear end of the seating surface 512, and may be formed to have a diameter corresponding to an inner diameter of an outlet side of each of the fastening holes 210 and 220. The fastening portion 520 may have a sufficient length so as to be inserted into an inside of the cabinet 10, and may have a structure in which a screw thread is formed at an outer surface thereof.

Therefore, while the fastening member 500 is inserted and fastened into the fastening holes 210 and 220, the seating surface 512 may be completely in close contact with the taper portion 211, and the fastening portion 520 may pass through the fastening holes 210 and 220, and may be inserted and fixed into the front surface of the cabinet 10.

The seating surface 512 of the fastening member 500 and the taper portion 211 of each of the fastening holes 210 and 220 may remain unchanged regardless of sizes of the fastening member 500 and the fastening holes 210 and 220, and even though the thickness of the hinge supporter 200 may be changed according to a supporting load of the door 20, the hinge supporter 200 may be fixed using the same fastening member 500.

Of course, when sizes of the main fastening hole 210 and the sub-fastening hole are different from each other, the fastening member 500 having different sized-head portion 510 and fastening portion 520 may be used.

The fitting hole 230 is located at a central portion of a width of the hinge supporter 200 and may extend in a direction to which the hinge supporter 200 extends. That is, a transverse center line of the fitting hole 230 may coincide with a line which divides equally the width of the hinge supporter 200. And the fitting hole 230 may have a size such that an insertion portion 310 formed at the hinge bracket 300 can be inserted therein, and may have an approximately quadrangular shape. The fitting hole 230 may have other non-circular shapes, including but not limited to triangular, pentagonal, and hexagonal shapes.

The fitting hole 230 may be located between a bracket support portion 240 and a supporter recessed portion 250 which will be described below, and at least one or more fitting holes 230 may be continuously formed at a predetermined interval.

The bracket support portion 240 may protrude from a front surface of the hinge supporter 200 in which the hinge bracket 300 is inserted. The bracket support portion 240 may extend along an outer edge of one pair of fitting holes 230 spaced apart from each other.

In some cases, a predetermined space may be formed at an inside of the bracket support portion 240 which is formed to be bent and extend in a bracket-like, and the pair of fitting holes 230 may be disposed in the space to pass through the hinge supporter 200.

A protruding longitudinal cross section of the bracket support portion 240 may be formed to be rounded convexly, and thus while the hinge bracket 300 may be installed at the hinge supporter 200, an inner edge of the bracket support portion 240 may be in close contact with an upper surface and a lower surface of the hinge bracket 300.

That is, while the hinge bracket 300 is coupled to the hinge supporter 200, the bracket support portion 240 may be in close contact with the hinge bracket 300, and thus a risk of forming a gap between the hinge supporter 200 and the hinge bracket 300 may be minimized. Therefore, when the hinge supporter 200 and the hinge bracket 300 are coupled to each other and then a surface treatment process of the hinge including a plating operation or a painting operation is performed, the surface treatment may be uniformly performed, and thus a defect rate of the hinge may be reduced.

The supporter recessed portion 250 may be formed at a rear surface of the hinge supporter 200 corresponding to an opposite surface to a surface at which the bracket support portion 240 is formed. The supporter recessed portion 250 may have a quadrangular shape having a predetermined area, and also formed to be recessed from the rear surface of the hinge supporter 200 in a predetermined depth or to be stepped. The supporter recessed portion 250 may be formed to have other non-circular shapes, including but not limited to triangular, pentagonal, and hexagonal shapes.

A recessed volume of the supporter recessed portion 250 may be the same as a protruding volume of the bracket support portion 240. That is, when the hinge supporter 200 is machined through the press working, the bracket support portion 240 may protrude from the front surface of the hinge supporter 200 by a volume formed by that a rear surface of the supporter recessed portion 250 is pressed and recessed. Therefore, a recessed depth of the supporter recessed portion 250 may correspond to a protruding height of the bracket support portion 240.

The fitting hole 230 may be formed at an inner area of the supporter recessed portion 250. The fitting hole 230 may be formed so that the insertion portion 310 of the hinge bracket 300 which will be described below can be inserted and coupled therein. The fitting hole 230 may be formed at positions which are slightly spaced apart from both of left and right sides of the bracket support portion 240. A distance between an upper (or lower) edge of the fitting hole 230 and an upper (or lower) edge of the supporter recessed portion 250 may be formed to be substantially the same as a width of the longitudinal cross section of the bracket support portion 240.

An expanding portion 231 may be formed at an outlet side edge of the fitting hole 230 to be inclined. Specifically, the expanding portion 231 may be formed along the outlet side edge of the fitting hole 230, and provides a space in which the insertion portion 310 is filled due to a deformation.

When the insertion portion 310 is inserted into the fitting hole 230, an end of the insertion portion 310 does not protrude further than the rear surface of the hinge supporter 200, but protrudes further than the outlet side edge of the fitting hole 230. In other words, the end of the insertion portion 310 may pass through the fitting hole 230 and protrude to the rear surface of the hinge supporter 200, but a length of a protruding portion thereof may be shorter than the recessed depth of the supporter recessed portion 250 (referring to FIG. 8).

In this state, a rear end of the insertion portion 310 which is exposed from the rear surface of the hinge supporter 200 may be pressed and deformed by a press working or a riveting process, among others. Then, the rear end of the insertion portion 310 may become close contact with the expanding portion 231 (referring to FIG. 10), and the end of the insertion portion 310 may be hooked and restricted by the rear surface of the hinge supporter 200. In this state, the insertion portion 310 may be defined by an insertion part which is located inside the fitting hole 230, and an expanding part which expands from an end of the insertion part and fills the expanding portion 231. The end of the insertion portion 310 may be located in the supporter recessed portion 250. Therefore, the hinge supporter 200 and the hinge bracket 300 may be prevented from easily separating, but rather can be maintained in a firmly coupled state. The end of the insertion portion 310 may also prevented from interfering with the front surface of the cabinet 10.

The hinge bracket 300 may be formed in a plate shape formed of a metallic material and having a predetermined area, and also may be formed to have a predetermined thickness and thus to support the weight of the door 20. Since the weight of the door 20 is directly applied to the hinge bracket 300, the thickness of the hinge bracket 300 may be formed thicker than that of the hinge supporter 200.

The hinge bracket 300 may be formed by the press working. That is, a shape of the hinge bracket 300, a pin insertion hole 320 in which the hinge pin 400 is inserted, a bracket recessed portion 330 for fixing the hinge pin 400, and the insertion portion 310 may be formed.

One pair of insertion portions 310 may be formed to protrude from a rear end of the hinge bracket 300 in parallel with each other, and may be formed to have a width which is inserted into an inside of the fitting hole 230.

Here, a cross section of the insertion portion 310 may be formed in a trapezoidal shape. And the insertion portion 310 may be pressed and deformed while being inserted into the fitting hole 230, and may completely fill the fitting hole 230. That is, a trapezoidal cross section thereof is deformed into a rectangular cross section through the pressing and deformation, and an outer circumferential surface of the insertion portion 310 is completely in close contact with an inner circumferential surface of the fitting hole 230.

Figure 4:
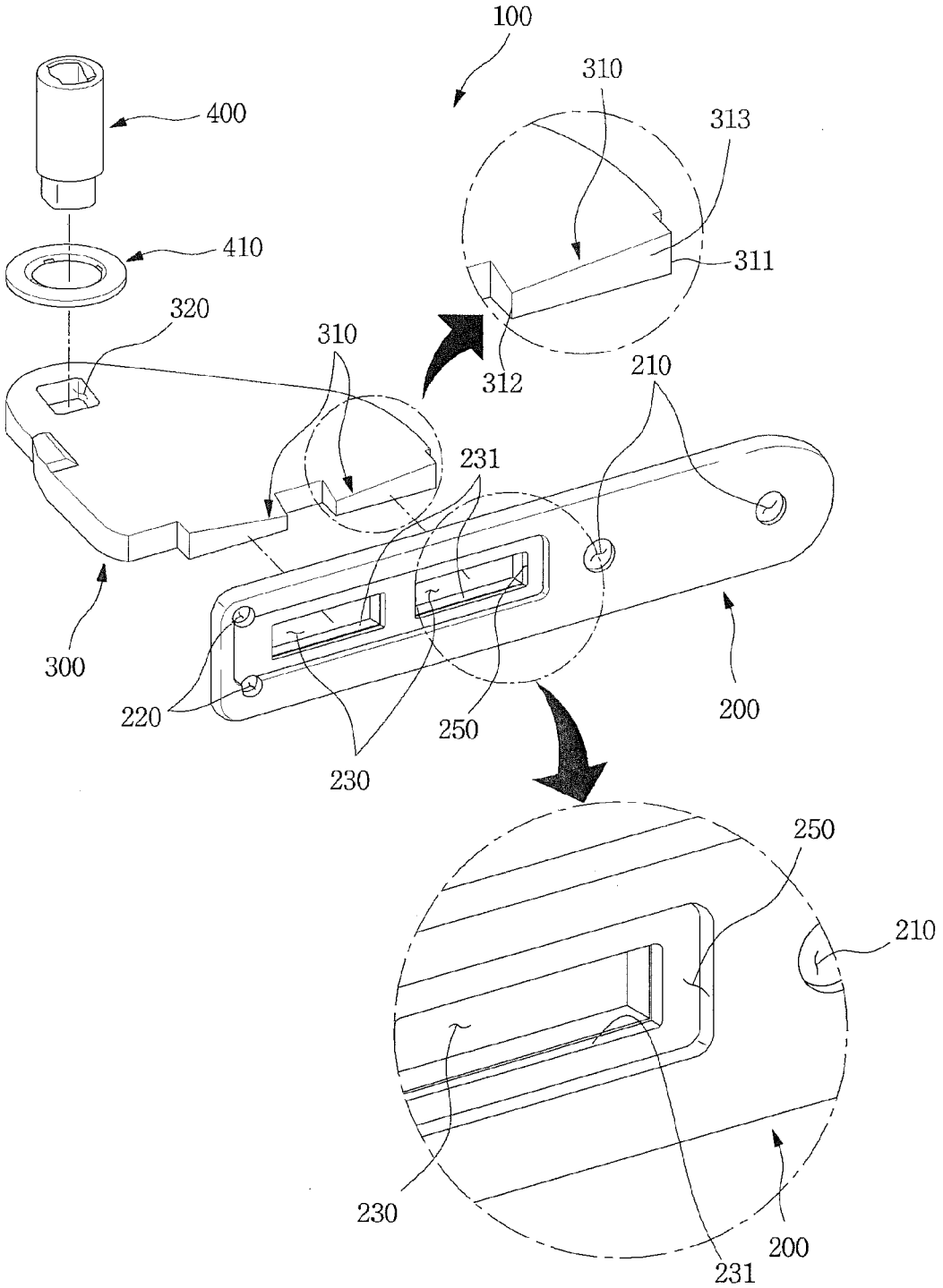
FIG. 4 is an exploded perspective view showing a rear side of the hinge.
Figure 5:
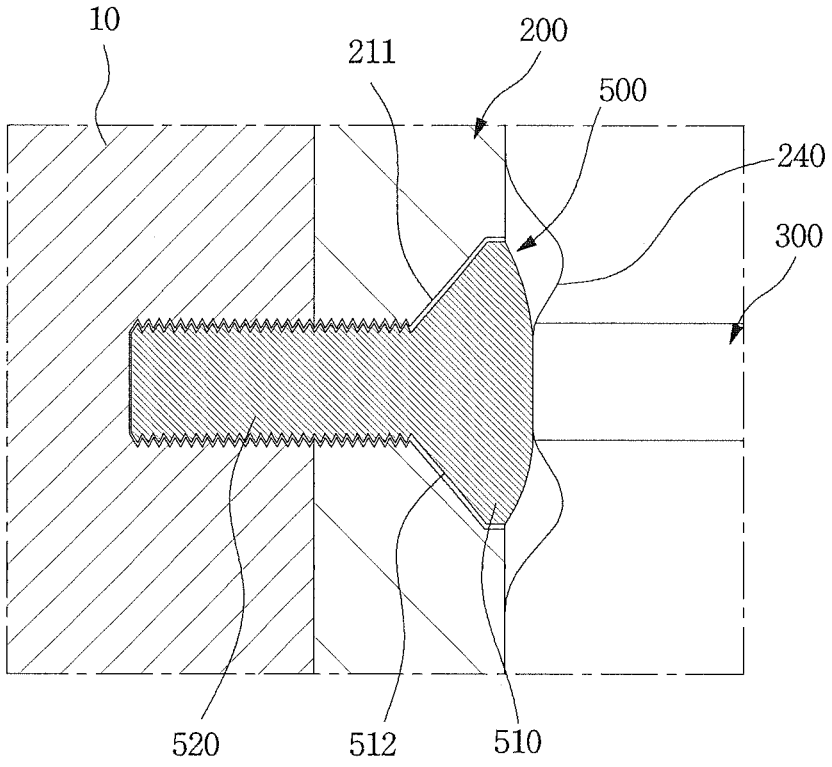
FIG. 5 is a longitudinal cross-sectional view taken along line 5-5' of FIG. 2.
Figure 6:
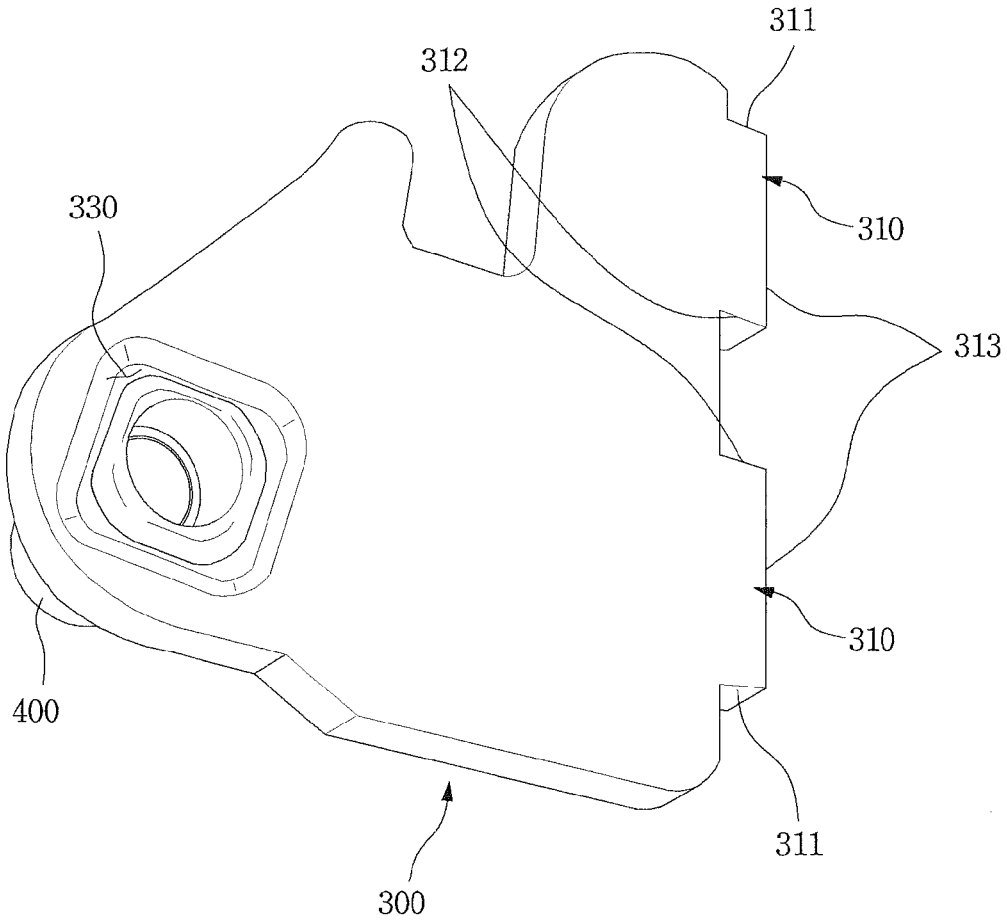
FIG. 6 is a perspective view showing an example coupling state between a hinge bracket and a hinge pin.

Specifically, the insertion portion 310 extends in a length which passes through the fitting hole 230 and protrudes, and a shape of the cross section may be formed in the trapezoidal shape. As illustrated in FIG. 4, the shape of the cross section of the insertion portion 310 may include a first surface 311 and a second surface 312 which form both side surfaces of the insertion portion 310, and a third surface 313 which connects between the first surface 311 and the second surface 312. The third surface 313 may be defined as a surface corresponding to an extending end of the insertion portion 310. One or all of an upper end and a lower end of the third surface 313 may be inclined in a direction which is gradually lowered from one of the first surface 311 and the second surface 312 toward the other. That is, a thickness of the insertion portion 310 may not be uniform, and one side thereof may be formed thinner than the other side. Therefore, when the insertion portion 310 is inserted into the fitting hole 230, a gap is generated at the fitting hole 230 (referring to FIGS. 7 and 8). In FIG. 8, the upper end and the lower end of the third surface 313, specifically, an upper surface and a lower surface of the insertion portion 310 are formed to be inclined, and thus the thickness of the insertion portion 310 becomes thinner. However, only one of the upper surface and the lower surface of the insertion portion 310 may be formed to be inclined.

Also, the thickness of the insertion portion 310 may be unevenly formed, and also an extending length of the first surface 311 and an extending length of the second surface 312 may be formed to be different from each other. That is, the third surface 313 may be formed to be inclined with respect to a horizontal line.

Alternatively, an extending length of the upper surface of the insertion portion 310 and an extending length of the lower surface thereof may be formed to be different from each other. That is, the third surface 313 may be formed to be inclined with respect to a vertical line.

The first surface 311 may be defined as a side surface which is directed to an outside of the hinge bracket 300, and the second surface 312 may be defined as a side surface opposite to the first surface 311. Therefore, the thickness of one of the first surface 311 and the second surface 312 is formed to be the same as a vertical width of the fitting hole 230, and the thickness of the other one is formed smaller than the vertical width of the fitting hole 230.

One or a plurality of insertion portions 310 may be formed. In the implementation, one pair of insertion portions 310 may be formed in parallel. And the second surfaces 312 which define the pair of insertion portions 310 are formed to face each other.

When an external force due to a press is applied to the end of the insertion portion 310 while the insertion portion 310 is inserted into the fitting hole 230, the thickness and the shape of the insertion portion 310 may be deformed. As a result, the insertion portion 310 can fill the fitting hole 230 and the expanding portion 231, and may therefore be completely in close contact with the inner circumferential surface of the fitting hole 230 and an inner circumferential surface of the expanding portion 231. Then, the insertion portion 310 may be prevented from becoming separated from the fitting hole 230.

The pin insertion hole 320 may have a shape corresponding to a shape of a cross section of a lower end of the hinge pin 400, and formed to pass through the hinge bracket 300. In one implementation, the pin insertion hole 320 and the lower end of the hinge pin 400 are formed to have a rectangular cross-sectional shape, but the implementation is not limited thereto. Therefore, while the hinge pin 400 is inserted into the pin insertion hole 320, the hinge pin 400 is fixed and coupled a rotating shaft provided at the lower end of the door 20, and serves as the rotating shaft of the door 20.

A washer 410 may be further provided between the pin insertion hole 320 and the hinge pin 400. The washer 410 has a through-hole having a size through which the hinge pin 400 passes, and is in contact with the door 20 or the rotating shaft of the door 20. Therefore, the washer 410 may be formed of a material, such as engineering plastic, having high wear resistance and excellent lubricating performance, and thus enables the door 20 to be smoothly rotated.

The bracket recessed portion 330 may be formed at the lower surface of the hinge bracket 300. The bracket recessed portion 330 may be formed at an outside of an outlet side of the pin insertion hole 320 to be recessed. Like the pin insertion hole 320, the bracket recessed portion 330 may be formed in the quadrangular shape, and forms a predetermined recessed space at an outside of the pin insertion hole 320. The bracket recessed portion 330 may be formed in other non-circular shapes, such as triangular, pentagonal, and hexagonal shapes.

Therefore, while the hinge pin 400 is installed in the pin insertion hole 320, the lower end of the hinge pin 400 is calked or welded, and the bracket recessed portion 330 is filled, and thus the hinge pin 400 is completely fixed to the hinge bracket 300. At this point, the lower end of the hinge pin 400 which is completely fixed may be formed not to protrude further than a recessed depth of the bracket recessed portion 330, and thus may be prevented from interfering with another door located under of the hinge 100.

A method of manufacturing the hinge having such a structure according to the implementation of the present disclosure will be described.

Figure 7:
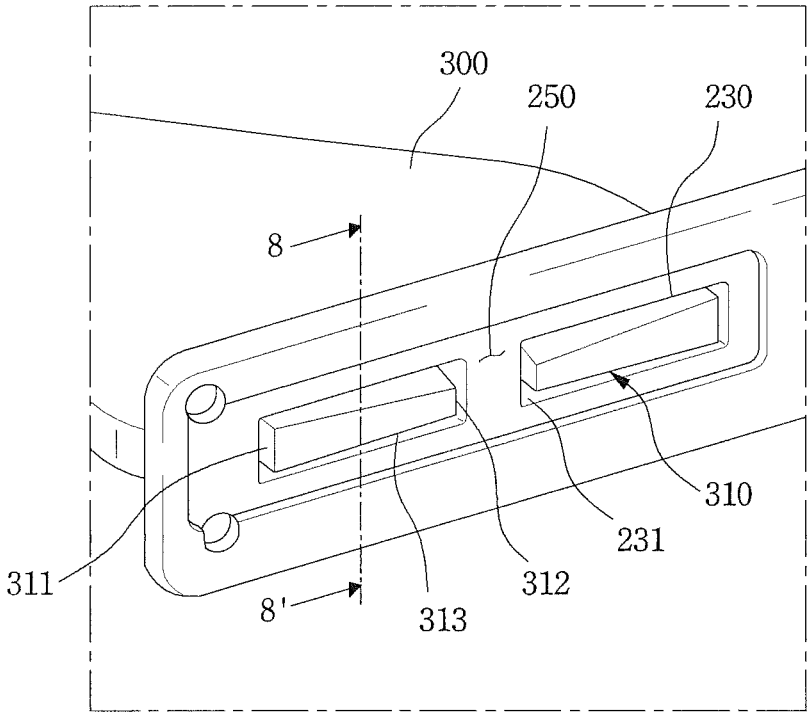
FIG. 7 is a perspective view showing an example of a temporarily assembled state of the hinge bracket and a hinge supporter of the hinge.
Figure 8:
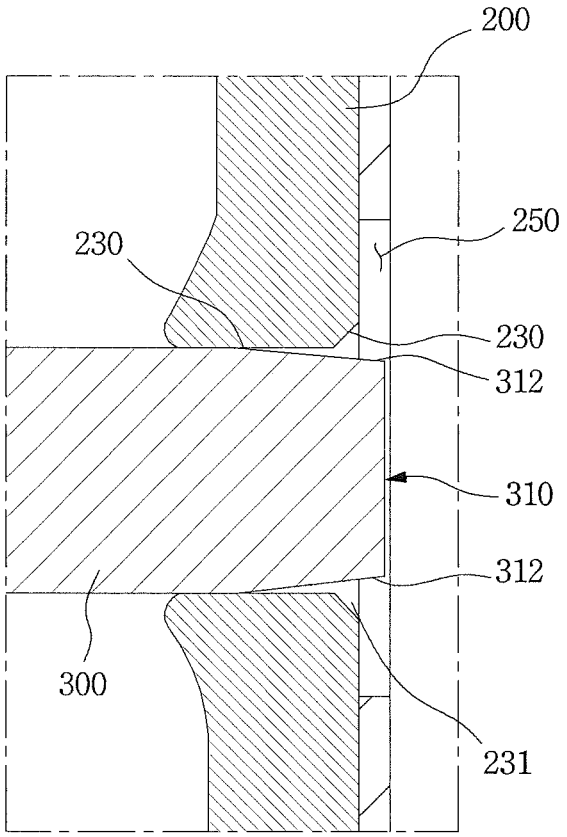
FIG. 8 is a longitudinal cross-sectional view taken along line 8-8' of FIG. 7.

Referring to FIGS. 7 and 8, to first begin manufacturing the hinge 100 according to an implementation of the present disclosure, the hinge supporter 200, the hinge bracket 300, and the hinge pin 400 are machined. At this time, entire shapes and detailed structures of the hinge supporter 200 and the hinge bracket 300 may be formed by the press working process.

The main fastening hole 210, the sub-fastening hole 220, and the fitting hole 230 may be formed at the hinge supporter 200 by the press working. When the supporter recessed portion 250 is formed, the bracket support portion 240 may be formed together.

Also, the shape of the hinge bracket 300, the pin insertion hole 320, the bracket recessed portion 330, and the insertion portion 310 may be by the press working.

A thickness (or a height) of the first surface 311 of the insertion portion 310 may be formed corresponding to a height of the fitting hole 230, and the second surface 312 may be formed smaller than the thickness of the first surface 311, and thus may be formed smaller than the height of the fitting hole 230.

One pair of insertion portions 310 may be formed close to each other in left and right directions, and the second surfaces 312 having a relatively short width are formed to face each other, and a stable fixing structure of the hinge bracket 300 may be provided.

When the hinge supporter 200 and the hinge bracket 300 are completely formed, the hinge supporter 200 and the hinge bracket 300 are assembled. To this end, first, the insertion portion 310 is inserted into the fitting hole 230. When the insertion portion 310 is completely inserted into the fitting hole 230, an end of the hinge bracket 300 from which the insertion portion 310 protrudes is inserted into an inside of a space formed by the bracket support portion 240, as illustrated in FIGS. 7 and 8.

Therefore, the insertion portion 310 may be supported at the inside of the fitting hole 230, and edges of the upper surface and the lower surface of the hinge bracket 300 may additionally supported by the bracket support portion 240. The rear end of the insertion portion 310 may pass through the fitting hole 230 and protrude, but may not protrude further than a surface which crosses the rear surface of the hinge supporter 200 (referring to FIG. 8). At this point, a protruding height of the insertion portion 310 is formed to have a volume which fills the inside of the fitting hole 230 including the expanding portion 231 when the end of the insertion portion 310 is pressed and deformed (referring to FIG. 10).

Figure 9:
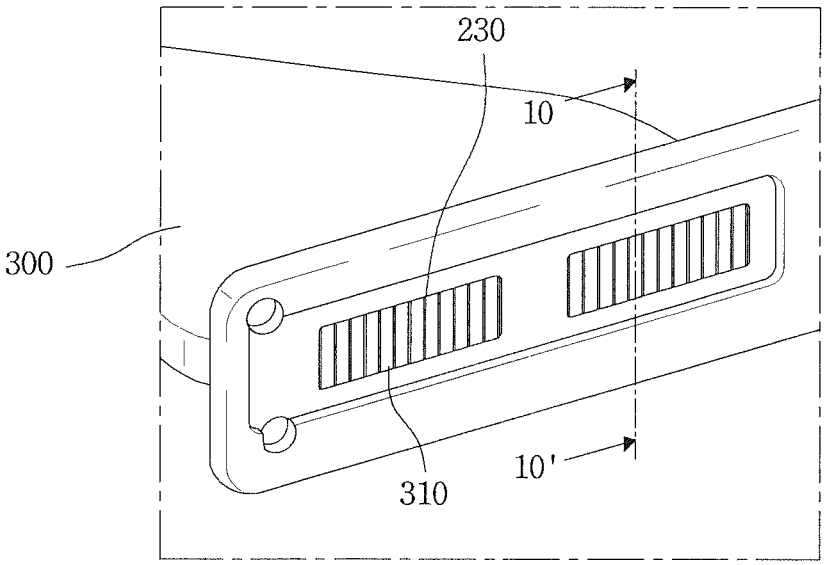
FIG. 9 is a partial perspective view showing an example of a completely assembled state of the hinge bracket and the hinge supporter.
Figure 10:
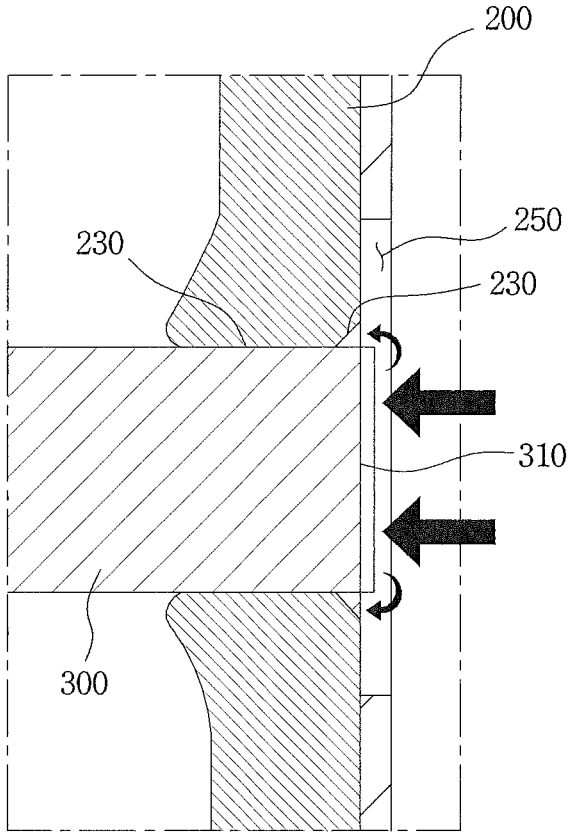
FIG. 10 is a longitudinal cross-sectional view taken along line 10-10' of FIG. 9.

Referring to FIGS. 9 and 10, the insertion portion 310 of the hinge bracket 300 is shown inserted into the fitting hole 230, and a temporarily assembled state by a mold or a jig is maintained. In this state, the rear end of the insertion portion 310 passed through the fitting hole 230 is pressed and deformed by the press working or the riveting, and the insertion portion 310 may be completely in close contact with the inner circumferential surface of the fitting hole 230 so that a space between the insertion portion 310 and the fitting hole 230 is not formed.

The rear end of the insertion portion 310 in the temporarily assembled state may be exposed backward through the outlet port of the fitting hole 230. At this point, when the rear end of the insertion portion 310 is pressed by the press working or the riveting, the insertion portion 310 can be deformed.

At this point, the first surface 311 can be in a closely contacting state with the inner circumferential surface of the fitting hole 230, and the third surface 313 can be deformed toward the inside of the fitting hole 230 by the deformation of the insertion portion 310 and may be in contact with the inner circumferential surface of the fitting hole 230. In a state in which the deformation of the insertion portion 310 is completed, the entire outer circumferential surface of the insertion portion 310 may be completely in contact with the inner circumferential surface of the fitting hole 230, and the rear end of the insertion portion 310 may fill the expanding portion 231 formed at the outlet port of the fitting hole 230. At this point, the remaining surfaces except the first surface 311 of the insertion portion 310 can be deformed to be simply in contact with the inner circumferential surface of the fitting hole 230, and thus a shape of the fitting hole 230 or a shape of the hinge supporter 200 may not be deformed while the end of the insertion portion 310 is pressed.

That is, in a coupling process between the hinge bracket 300 and the hinge supporter 200, the deformation of the hinge supporter 200 may be minimized while a coupled state between the hinge bracket 300 and the hinge supporter 200 is maintained.

In a state in which the hinge bracket 300 is completely fixed to the hinge supporter 200, the hinge supporter 200 and the hinge bracket 300 are crossed at a right angle, and the inner edge of the bracket support portion 240 may be in contact with the upper surface and the lower surface of the hinge bracket 300.

In a state in which the hinge supporter 200 and the hinge bracket 300 are completely assembled, the surface treatment such as the plating process or the painting process may be performed on surfaces of the hinge supporter 200 and the hinge bracket 300. A layer formed on the surfaces of the hinge supporter 200 and the hinge bracket 300 by the plating process or the painting process may be defined as a surface treatment layer.

In the surface treatment process of the hinge supporter 200 and the hinge bracket 300, since the inner edge of the bracket support portion 240 and the upper surface and the lower surface of the hinge bracket 300 are completely in contact with each other, an assembling gap may not be formed at a portion at which the hinge supporter 200 and the hinge bracket 300 are in contact with each other. Therefore, a defect in the surface treatment may be minimized or prevented.

After the surface treatment is completed, the hinge pin 400 is coupled to the hinge bracket 300. To this end, first, the hinge pin 400 is inserted and fixed into the pin insertion hole 320. And the hinge pin 400 exposed under the pin insertion hole 320 may be fixed to the hinge bracket 300 within an area of the bracket recessed portion 330 by a calking or a welding.

When an installation of the hinge pin 400 and the surface treatment are completed, assembling of the hinge 100 is completed. In this state, the hinge 100 is located at the front surface of the cabinet 10 to install the hinge 100, and then the fastening member 500 is inserted into the main fastening hole 210 and the sub-fastening hole 220 so that the hinge 100 is fixed to the front surface of the cabinet 10. And after the hinge 100 is installed and fixed to the cabinet 10, a hinge shaft of the lower end of the door 20 and the hinge pin 400 are coupled to each other.

When the installation of the hinge 100 and the assembling of the door 20 are completed, the hinge 100 supports the door 20 at a lower surface of the door 20, and the door 20 may be rotatably installed at the cabinet 10 by the hinge 100.

The refrigerator hinge according to the present disclosure may be implemented according to various other implementations other than the one described above.

Another implementation of the present disclosure can be characterized by providing a structure in which a first insertion portion and a second insertion portion are provided at the hinge bracket, and the hinge bracket is fixed without the deformation of the hinge supporter.

Another implementation of the present disclosure can have the same configuration as that of the previous implementation, only except a structure of the first insertion portion and the second insertion portion of the hinge bracket and a structure of a first fitting hole and a second fitting hole of the hinge supporter which are coupled thereto, and thus like reference numerals refer to like elements, and repeated description thereof will be omitted.

Figure 11:
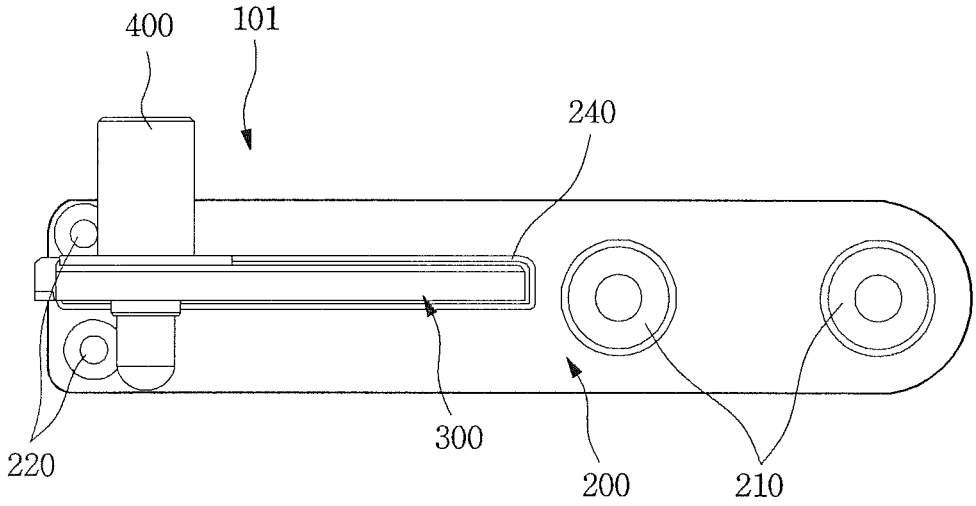
FIG. 11 is a front view showing another implementation of a hinge.
Figure 12:
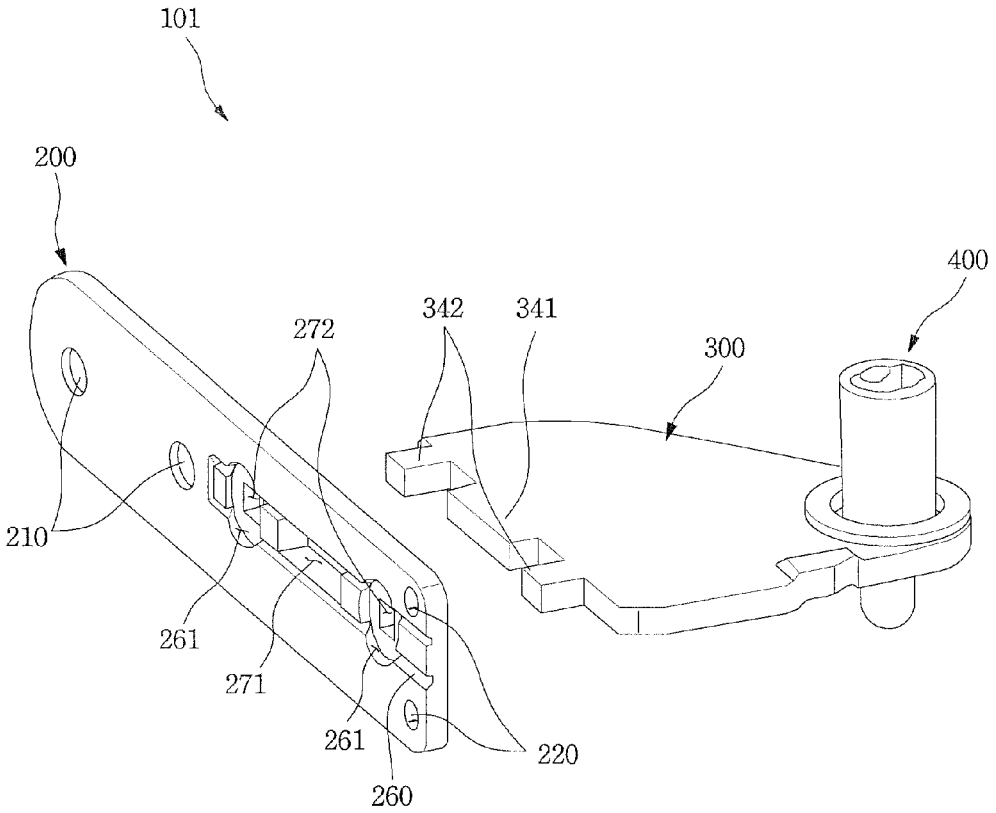
FIG. 12 is an exploded perspective view of the hinge shown in FIG. 11.
Figure 13:
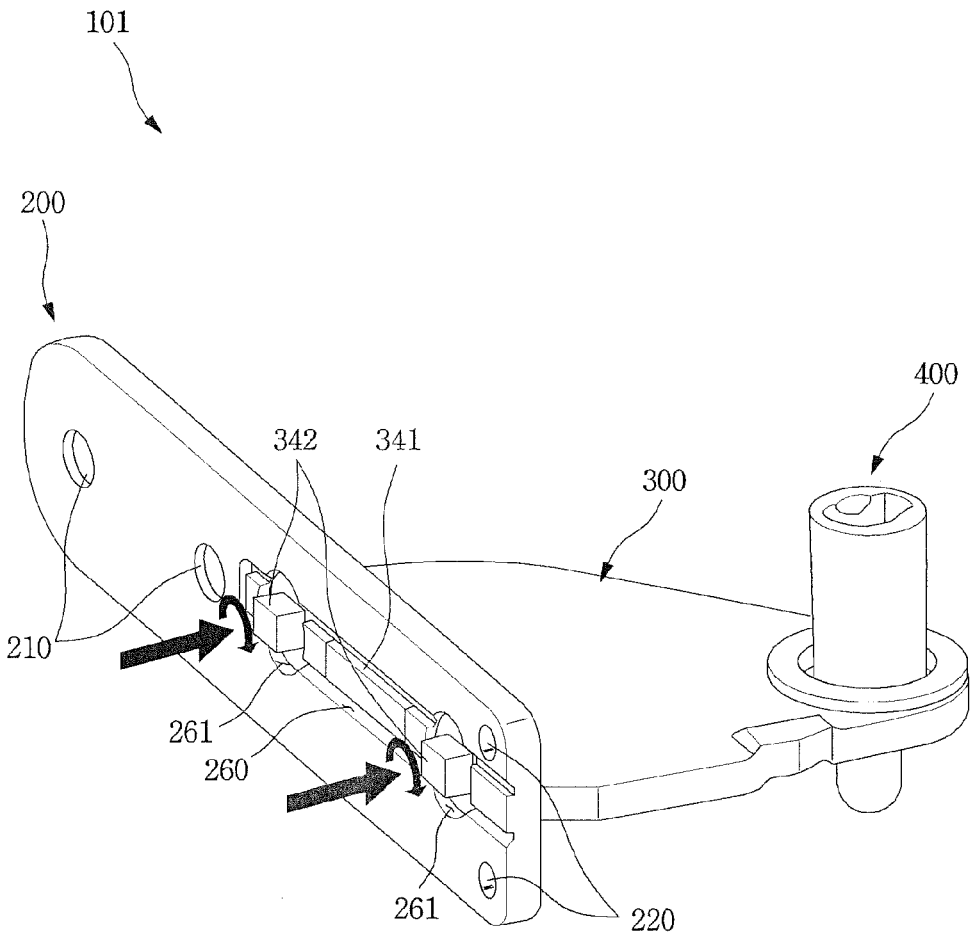
FIG. 13 is a perspective view showing an example of a temporarily assembled state of a hinge bracket and a hinge supporter of the hinge shown in FIG. 11.

Referring to FIGS. 11 to 13, a hinge 101 according to another implementation may include a hinge supporter 200 which is installed and fixed to the front surface of the cabinet 10, a hinge pin 400 which is inserted into a lower end of the door 20 and serves as a rotating shaft, and a hinge bracket 300 at which the hinge pin 400 is installed and which is coupled to the hinge supporter 200 and supports the door 20. This structure is substantially the same as that of the previous implementation described earlier.

A plurality of fitting holes for coupling with the hinge bracket 300 may be formed at the hinge supporter 200. The plurality of fitting holes may be formed at an area of a support recessed portion 260 which is formed at the hinge supporter 200 to be recessed.

A bracket support portion 240 which protrudes so as to have a volume corresponding to a recessed volume of the support recessed portion 260 is formed at a surface of the hinge supporter 200 opposite to a surface at which the support recessed portion 260 is formed. Each of the support recessed portion 260 and the bracket support portion 240 are formed to be bent and extend in a bracket-like shape.

When the hinge bracket 300 is installed, the bracket support portion 240 may be in contact with edges of an upper surface and a lower surface of the hinge bracket 300, and can further support the hinge bracket 300.

A main fastening hole 210 and a sub-fastening hole 220 which enable the hinge supporter 200 to be installed and fixed to the barrier 11 may be formed at the hinge supporter 200. A fastening member 500 may be inserted into the main fastening hole 210 and the sub-fastening hole 220, and can enable the hinge supporter 200 to be installed and fixed to the cabinet 10.

The plurality of fitting holes may include a first fitting hole 271 in which a first insertion portion 341 protruding from one end of the hinge supporter 200 is inserted, and second fitting holes 272 in which one pair of second insertion portions 342 protruding respectively from left and right sides of the first insertion portion 341 are inserted. The second fitting holes 272 may be formed at left and right sides of the first fitting hole 271, respectively.

The first fitting hole 271 may be formed in a quadrangular shape corresponding to a longitudinal cross-sectional shape of the first insertion portion 341. Other non-circular shapes, such as triangular, pentagonal, and hexagonal shapes, may be used. An inner circumferential surface of the first fitting hole 271 is in contact with an outer circumferential surface of the first insertion portion 341, and serves to support the hinge bracket 300. And the second fitting holes 272 may be formed at points spaced apart from the left and right sides of the first fitting hole 271, respectively, and vertical widths of the first and second fitting holes 271 and 272 are the same as each other, and centers thereof may be on the same plane.

Each of the second fitting holes 272 may be formed in a quadrangular shape corresponding to a longitudinal cross-sectional shape of the second insertion portion 342, and may be formed at both of the left and right sides of the first fitting hole 271. The second fitting holes 272 may also have other non-circular shapes, such as triangular, pentagonal, and hexagonal shapes. A size of each of the second fitting holes 272 may be formed relatively smaller than that of the second insertion portion 342, and the second insertion portion 342 may be fitted to the second fitting hole 272. And the size of the second insertion portion 342 may be formed so that the second fitting hole 272 is not deformed when the second insertion portion 342 is fitted to the second fitting hole 272.

A circular accommodation portion 261 may be formed at a surface of the hinge supporter 200 corresponding to an outlet side of the second fitting hole 272 so as to be recessed. Specifically, the accommodation portion 261 forms a part of the support recessed portion 260, and a center of a curvature of the accommodation portion 261 may coincide with a center of the second fitting hole 272. And when an end of the second insertion portion 342 is pressed and deformed, a deformed portion of the second insertion portion 342 may widely spread and fill the accommodation portion 261.

The hinge pin 400 may be installed at one side of the hinge bracket 300, and may serve as a rotating shaft of the refrigerator compartment door 20. The hinge pin 400 may be inserted into and pass through a most distal end of the hinge bracket 300 at which the first and second insertion portions 341 and 342 are formed.

The first insertion portion 341 may support a vertical load applied to the hinge bracket 300 while being inserted into the first fitting hole 271. And the first insertion portion 341 may be formed so that a rear end of the first insertion portion 341 does not protrude further than a rear surface of the hinge supporter 200 while the first insertion portion 341 is completely inserted into the first fitting hole 271. That is, while the first insertion portion 341 is completely inserted into the first fitting hole 271, a rear end of the hinge bracket 300 may be in contact with a front surface of the hinge supporter 200, and the rear end of the first insertion portion 341 and a rear end of the first fitting hole 271 may be located on the same plane. A distance between the rear surface of the hinge supporter 200 and the rear end of the first fitting hole 271 corresponds to a recessed depth of the support recessed portion 260. The end of the first insertion portion 341 may be located within a recessed area of the support recessed portion 260.

The second insertion portion 342 may be located at both of left and right sides of the first insertion portion 341, and extend backward longer than the first insertion portion 341. That is, the second insertion portion 342 may be formed to pass through an open rear surface of the second fitting hole 272 and to further protrude while being inserted into the second fitting hole 272. At this point, the second insertion portion 342 may be formed to have a protruding length which fills the accommodation portion 261 when the second insertion portion 342 is deformed.

The second insertion portion 342 may be formed to have a quadrangular cross-sectional shape which is smaller than the first insertion portion 341, and to pass through the second fitting hole 272 having a corresponding shape. In some cases, the second insertion portion 342 may be formed to have other non-circular cross-sectional shapes, such as triangular, pentagonal, and hexagonal shapes.

Figure 14:
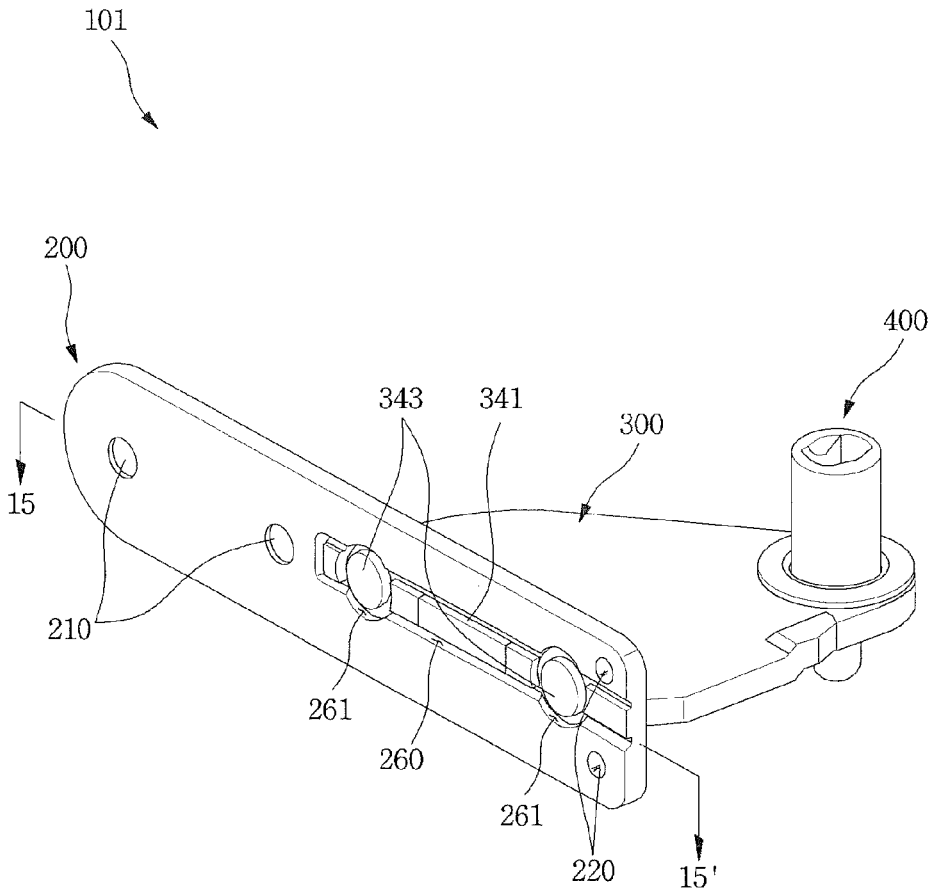
FIG. 14 is a perspective view shown an example of a completely assembled state of the hinge bracket and the hinge supporter shown in FIG. 13.
Figure 15:
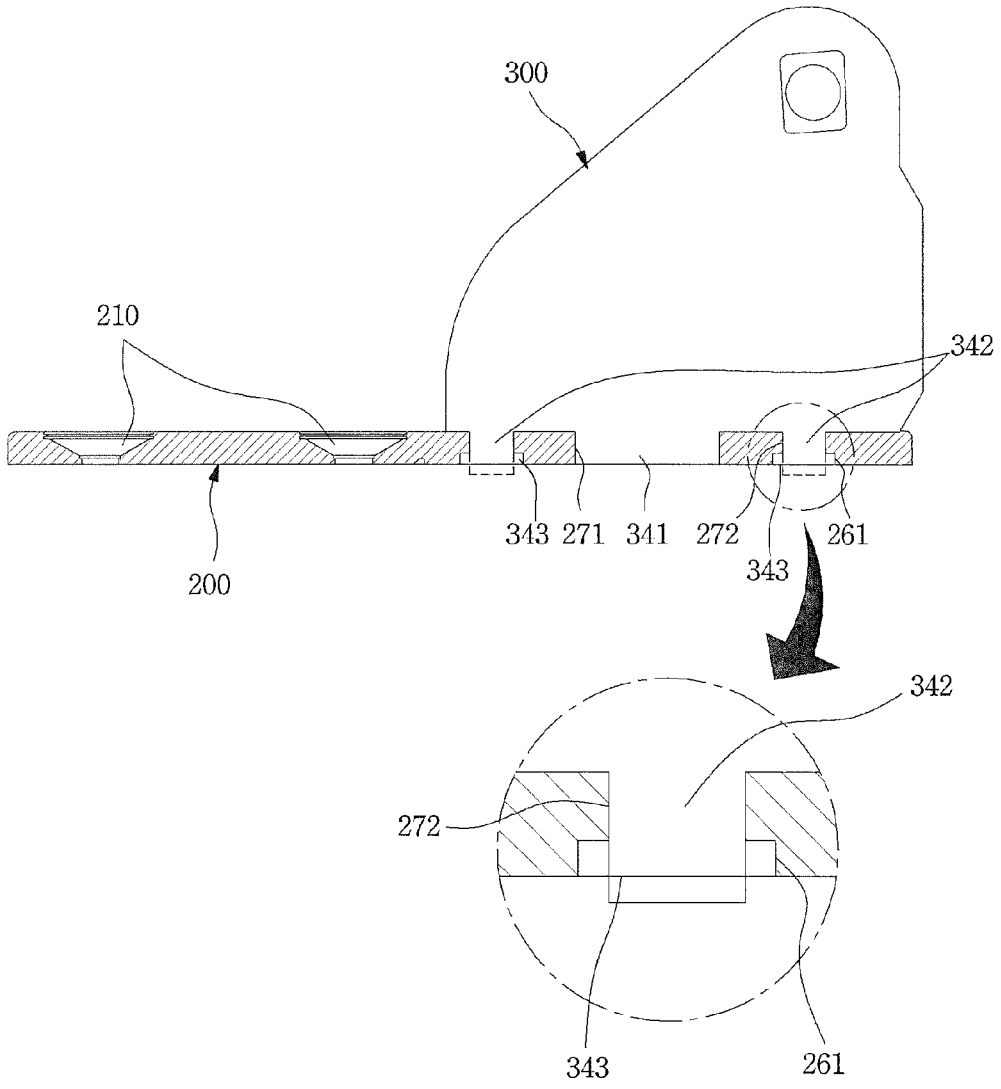
FIG. 15 is a cross-sectional view taken along line 15-15' of FIG. 14.

Referring now to FIGS. 14 and 15, while the second insertion portion 342 is inserted into the second fitting hole 272, an end of the second insertion portion 342 passed through the second fitting hole 272 and protruding in front of the hinge supporter 200 is machined by a spinning, for instance. The spinning refers to a machining process in which a spinning part in contact with the end of the second insertion portion 342 presses an end surface of the second insertion portion 342 while being rotated.

Due to the pressed and deformed second insertion portion 342, the hinge bracket 300 is installed and fixed to the hinge supporter 200. That is, by the spinning, the second insertion portion 342 having a simply extending shape fills the accommodation portion 261, and is deformed in a circular plate shape corresponding to a shape of the accommodation portion 261. And due to such a deformation, the second insertion portion 342 may be maintained in a firmly coupled state to the hinge supporter 200.

In brief, when the hinge bracket 300 is installed and fixed to the hinge supporter 200, the first insertion portion 341 is inserted and fixed into an inside of the first fitting hole 271, and the second insertion portion 342 is pressed and deformed, and completely fills the second fitting hole 272 and the accommodation portion 261.

The refrigerator hinge and the manufacturing method thereof according to the implementation of the present disclosure may have the following effects.

First, the hinge according to the implementation of the present disclosure may be formed by coupling the hinge supporter and the hinge bracket which may be machined by the press working. In the press working, the bracket support portion having the volume corresponding to the supporter recessed portion may protrude from the front surface of the hinge supporter. And when the hinge bracket is coupled, the bracket support portion may cover and support the end of the hinge bracket.

Therefore, the hinge may be doubly supported by a support structure of the bracket support portion and the hinge bracket in addition to a coupling structure between the insertion portion and the fitting hole, and the door having a heavier weight may thus be more stably supported.

Second, the shape of the cross section of the insertion portion of the hinge may be formed to be inclined from one end toward the other end, and also formed so that the width thereof is slightly narrow. Therefore, in a process in which the insertion portion is accommodated and pressed in the fitting hole, a portion thereof having a large width may perform a fixing function which is fixed into the fitting hole by the deformation, and a portion thereof having a relatively narrow width may fill the fitting hole by the deformation.

Therefore, due to the deformation of the insertion portion, the deformation of the fitting hole or the hinge bracket close to the fitting hole may be mitigated or prevented, and the gap or the defect of the exterior due to the deformation may be mitigated or prevented.

Third, an inclined portion may be formed at the outlet side of the fitting hole, and the rear end of the insertion portion is pressed while the insertion portion is inserted, and thus the insertion portion is deformed, and the inclined portion and the deformed rear end of the insertion portion can be completely in close contact with each other.

Therefore, formation of a gap between the fitting hole and the insertion portion may be mitigated or prevented, and the hinge supporter and the hinge bracket may be more firmly coupled to each other due to a closely contacting structure of the inclined portion and the insertion portion.

Fourth, the first insertion portion of the hinge bracket may be be inserted into the first fitting hole of the hinge supporter, and thus the hinge bracket may be fixed to and supported by the hinge supporter. The second insertion portion may pass through the second fitting hole to be pressed and deformed, and thus the hinge bracket may be maintained in a coupled state to the hinge supporter.

Through this, while a pressed and deformed portion of the hinge bracket can be minimized, a coupling structure between the hinge bracket and the hinge supporter may be realized, and the deformation of the hinge supporter due to the pressing of the hinge bracket may be minimized.

Even though all the elements of the implementations are coupled into one or operated in the combined state, the present disclosure is not limited to such an implementation. That is, all the elements may be selectively combined with each other without departing from the scope of the disclosure. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although implementations have been described with reference to a number of illustrative implementations thereof, it will be understood by those skilled in the art that various changes in form and details may be made therein without departing from the spirit and scope of the disclosure as defined by the appended claims. Therefore, the preferred implementations should be considered in a descriptive sense only and not for purposes of limitation, and also the technical scope of the disclosure is not limited to the implementations. Furthermore, the present disclosure is defined not by the detailed description of the disclosure but by the appended claims, and all differences within the scope will be construed as being comprised in the present disclosure.

What is claimed is:

1. A refrigerator hinge comprising:

a hinge supporter configured to be mounted on a front surface of a cabinet of a refrigerator, the hinge supporter defining a fitting hole and including a bracket support portion that at least partially surrounds an edge of the fitting hole and protrudes from a front surface of the hinge supporter and a supporter recessed portion recessed into a rear surface opposite the front surface, wherein the fitting hole further comprises an inclined expanding portion;

a hinge bracket configured to be perpendicularly coupled to the hinge supporter, the hinge bracket including an insertion portion that protrudes from a first end of the hinge bracket and is configured to be inserted into the fitting hole, wherein prior to insertion into the fitting hole, the insertion portion has a non-uniform thickness, such that a first side of the insertion portion is thicker than a second side of the insertion portion, wherein the insertion portion is configured to be deformed after insertion into the fitting hole for engagement with the inclined expanding portion; and a hinge pin configured to be coupled to a second end of the hinge bracket opposite the first end, wherein when the hinge bracket is coupled to the hinge supporter, an inner edge of the bracket support portion contacts an outer circumferential surface of the hinge bracket.

2. The refrigerator hinge according to claim 1, wherein the fitting hole has a non-circular shape.

3. The refrigerator hinge according to claim 2, wherein the fitting hole has a quadrangular shape.

4. The refrigerator hinge according to claim 1, wherein the rear surface is configured to contact the front surface of the cabinet; and wherein the bracket support portion is convexly rounded relative to the front surface.

5. The refrigerator hinge according to claim 4, wherein the fitting hole is defined within the supporter recessed portion.

6. The refrigerator hinge according to claim 5, wherein a volume of the supporter recessed portion corresponds to a volume of the bracket support portion.

7. The refrigerator hinge according to claim 6, wherein the insertion portion is configured to deform to completely fill the fitting hole and the inclined expanding portion.

8. The refrigerator hinge according to claim 7, wherein the insertion portion, prior to being deformed to completely fill the fitting hole and the inclined expanding portion, does not protrude rearward past the rear surface of the hinge supporter.

9. The refrigerator hinge according to claim 7, wherein the insertion portion comprises: an insertion part that is configured to be positioned within the fitting hole; and an expanding part that is configured to be positioned at the expanding portion, the expanding part extending from an end of the insertion part and configured to expand.

10. The refrigerator hinge according to claim 1, wherein outer surfaces of the hinge supporter and the hinge bracket include a surface treatment layer.

11. The refrigerator hinge according to claim 10, wherein the surface treatment layer is plated or painted on the outer surfaces of the hinge supporter and the hinge bracket.

* * * * *